US006851284B2

(12) United States Patent
Kim et al.

(10) Patent No.: US 6,851,284 B2
(45) Date of Patent: Feb. 8, 2005

(54) HANDCUFFS

(76) Inventors: Ki Suk Kim, 30-705, Eunma Apt., 316 Daechi-dong, Kangnam-gu, Seoul 135-280 (KR); Jeong Su Kwon, 30-705, Eunma Apt., 316 Daechi-dong, Kangnam-gu, Seoul 135-280 (KR)

( * ) Notice: Subject to any disclaimer, the term of this patent is extended or adjusted under 35 U.S.C. 154(b) by 21 days.

(21) Appl. No.: 10/614,756

(22) Filed: Jul. 7, 2003

(65) Prior Publication Data

US 2004/0237604 A1 Dec. 2, 2004

(30) Foreign Application Priority Data

Jul. 12, 2002 (KR) ..... 10-2002-0040614

(51) Int. Cl.[7] ..... E05B 75/00
(52) U.S. Cl. ..... 70/16
(58) Field of Search ..... 70/15–17; 16/233, 16/235, 247, 270, 366, 368; 54/71; 119/816

(56) References Cited

U.S. PATENT DOCUMENTS 368,539 A * 8/1887 Ludlow ..... 16/366
3,618,345 A * 11/1971 Smith ..... 70/16
4,089,195 A * 5/1978 Lai ..... 70/16
4,300,368 A * 11/1981 Sullivan ..... 70/16
5,205,142 A * 4/1993 Kruger et al. ..... 70/16
5,461,890 A * 10/1995 LeFavor ..... 70/16
5,526,658 A * 6/1996 Cross et al. ..... 70/16
5,598,723 A * 2/1997 Ecker et al. ..... 70/16
5,687,593 A * 11/1997 Cross ..... 70/16
6,568,224 B1 * 5/2003 Taper et al. ..... 70/16
6,574,998 B2 * 6/2003 Kwon ..... 70/16
2002/0108406 A1 * 8/2002 Makos et al. ..... 70/16
2002/0189303 A1 * 12/2002 Kwon ..... 70/16

* cited by examiner

*Primary Examiner*—Lloyd A. Gall
(74) *Attorney, Agent, or Firm*—Porter Wright Morris & Arthur LLP

(57) ABSTRACT

The present invention relates to a pair of handcuffs which cannot be disassembled easily by securing a firm connection therebetween by hinge members. The handcuffs according to the present invention are made by the methods of shearing and bent-up forming in replacement of the conventional cast-iron method, and are connected by a connecting structure which comprises two frame plates, each of which includes a plurality of hinge members forming grooves between the neighboring hinge members and having openings therethrough and also includes a pair of flat members; couplings fitted into the grooves of the hinge members; and hinge axes to be axially fitted into the openings of the hinge members and the couplings.

6 Claims, 4 Drawing Sheets

HANDCUFFS

FIELD OF THE INVENTION

The present invention relates to a set of handcuffs which are connected to each other by hinge members, and more particularly to a pair of handcuffs which are foldable centering around the hinge members and cannot be disassembled easily by securing a firm connection by means of hinge members which are connected by a plurality of couplings.

BACKGROUND OF THE INVENTION

Conventionally, each of a pair of handcuffs comprises two rectangular base bodies which accommodate frame plates, a partition plate between the frame plates, a pair of pawl pieces and a leaf spring therein; a movable arm formed in a semi-circle shape, which is provided at its free end with a ratchet portion formed with dual line of teeth; and a pair of fixed arms formed in a semi-circle shape, which are pivotably connected at free ends thereof to the other end of the movable arm by a pivot pin and are integrally provided at their other ends with the rectangular base bodies, wherein the dual line of teeth in the movable arm are movably engaged with the pawl pieces of the base bodies. The base bodies of the handcuffs are connected each other by chains or rings.

Further, it has been known that the base bodies are connected each other by a hinge instead of the connecting chains or rings. One hinge member has its one end fixed on the base body of the handcuff and has the other end thereof connected to one end of the other hinge member by a hinge pin, so that a pair of handcuffs can be foldable on each other.

In case of the above handcuffs, one end of the hinge member fixed on the base body of the handcuff has to be formed flat, while the other end of the hinge member connected to the other hinge member has to be formed in a hinge shape. In this regard, however, in order to prevent the handcuffs from being easily picked or disassembled, there should be no gap between the flat part and the hinge part of the hinge members, and particularly a hinge opening should be integrally formed in each of the hinge member. For this reason, for the integral formation of the hinge openings, the flat parts and the hinge parts must be formed by cast-iron method.

Accordingly, due to the cast-iron formation, the weight of the handcuffs becomes increased and it is inconvenient to carry along the handcuffs. Also, the productivity and workability of the handcuffs are remarkably deteriorated due to the cast-iron formation method, and thus the manufacturing cost of the handcuffs is increased.

SUMMARY OF THE INVENTION

The object of the present invention is to solve the above disadvantages of the conventional handcuffs and to provide handcuffs which cannot be disassembled easily by a firm connection between a pair of handcuffs by means of hinge members which are connected by a plurality of couplings.

Another object of the present invention is to provide handcuffs made by the methods of shearing and bent-up forming in replacement of the conventional cast-iron method.

A further object of the present invention is to provide a handcuff having an integrally formed frame plate consisting of flat members and hinge members.

A further object of the present invention is to provide a handcuff having a partition plate interposed between the integrally formed frame plate through a slit for partition, so that the partition plate can be assembled quickly into the frame plate and fixed therein securely, and consequently the teeth of a ratchet portion of a movable arm can be securely engaged with pawl pieces included in the base bodies.

A further object of the present invention is to provide handcuffs which cannot be picked or disassembled by an external impact or an unwanted insertion of a foreign metal object.

In order to achieve the above objects, the handcuffs of the present invention comprises a pair of handcuff parts and a connecting structure, each of the handcuff parts comprising a pair of rectangular base bodies which accommodate both ends of a frame plate, a partition plate interposed between the ends of the frame plate, a pair of pawl pieces and a leaf spring therebetween; a movable arm formed in a semi-circle shape, which is provided at its free end with a ratchet portion formed with dual line of teeth; and a pair of fixed arms formed in a semi-circle shape, which are pivotably connected at free ends thereof to the other end of the movable arm by a pivot pin and are integrally provided at their other ends with the base bodies, and the connecting structure comprising two integrally formed frame plates, each of which includes a plurality of hinge members exposed to the outside of the base bodies, forming grooves between the neighboring hinge members and having openings therethrough, and also includes a pair of flat members at its both ends integrally extended from the hinge members to be contained in the base bodies; couplings fitted into the grooves of the hinge members of both the frame plates, each of the couplings having openings at its both ends; and hinge axes to be axially fitted into the openings of the hinge members and the openings of the couplings.

The frame plate has a gap between the two flat members to receive and fix the partition plate therein.

Each of the hinge members integrally extended from the ends of the flat members is separated from each other by the same interval to form a groove with a neighboring hinge member.

Further, each of the couplings having openings at its both ends is fitted into the grooves formed between the neighboring hinge members, and the hinge axis is alternately fitted into the openings of the hinge members and the openings of the couplings, so that the pair of handcuffs can move smoothly and can be foldable around the connecting structure.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention, wherein.

DETAILED DESCRIPTION OF THE PREFERRED EMBODIMENTS

Figure 1:
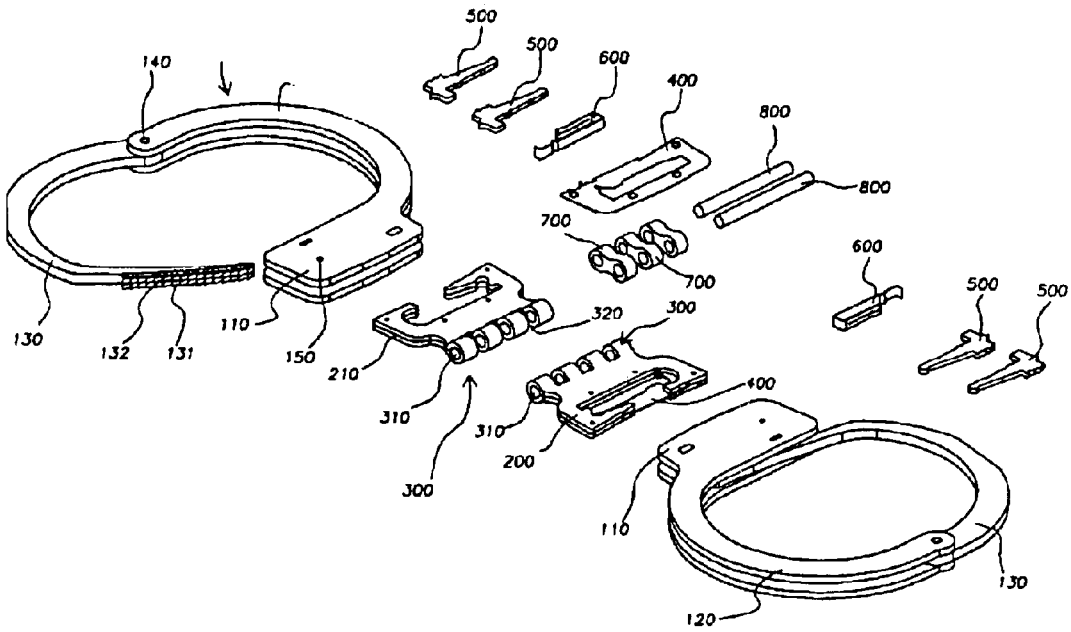
FIG. 1 is a disassembled perspective view of handcuffs according to the present invention.

Reference will now be made in detail to a preferred embodiment of the present invention in conjunction with the accompanying drawings.

The handcuffs according to the present invention comprises a pair of handcuff parts (100) and a connecting structure, each of the handcuff parts (100) comprising rectangular base bodies (110) which accommodate both ends of a frame plate (200), a partition plate (400) interposed between the ends of the frame plate (200), a pair of pawl pieces (500) and a leaf spring (600) therein; a movable arm (130) formed in a semi-circle shape, which is provided at its free end with a ratchet portion formed with dual line of teeth (131); and a pair of fixed arms (120) formed in a semi-circle shape, which are pivotably connected at free ends thereof to the other end of the movable arm (130) by a pivot pin (140) and are integrally provided at their other ends with the base bodies (110), and the connecting structure comprising two frame plates (200), each of which includes a plurality of hinge members (300) exposed to the outside of the base bodies (110), forming grooves (320) between the neighboring hinge members (300) and openings (310) therethrough, and also includes a pair of flat members at its both ends integrally extended from the hinge members (300) to be contained in the base bodies (110); a plurality of couplings (700) fitted into the grooves (320) of the hinge members (300) of both the frame plates (200), each of the couplings (700) having openings at its both ends; and hinge axes (800) to be axially fitted into the openings (310) of the hinge members (300) and the openings of the couplings (700).

In general, each of the handcuff parts (100) is put by the engagement of the dual line of teeth (131) provided at the end of the movable arm (130) with the pair of teeth of pawl pieces (500).

As shown in FIG. 1, the frame plate (200) is integrally formed to have a plurality of the hinge members (300) in its center and two flat members overlapped with each other at its both ends, so that the partition plate (400) can be interposed and fixed between the two flat members of the frame plate (200).

The frame plate (200) is formed into an integral body by shearing and is folded by the bent-up forming to have the two flat members overlapped.

In folding the frame plate (200), the hinge members (300) are integrally formed with the flat members, but formed to protrude outside of the base bodies (110).

Figure 3:
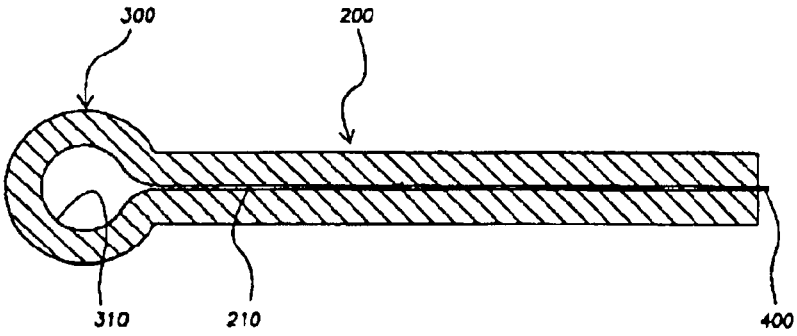
FIG. 3 is an enlarged sectional view of a frame plate of a handcuff according to the present invention.

As shown in FIG. 3, the frame plate (200) is folded to form a gap (210) between the two flat members, so that the partition plate (400) can be inserted therein.

Further, each of the hinge members (300) integrally extended from the ends of the flat members is separated from each other by the same interval to form the groove (320) with a neighboring hinge member (300).

Figure 2:
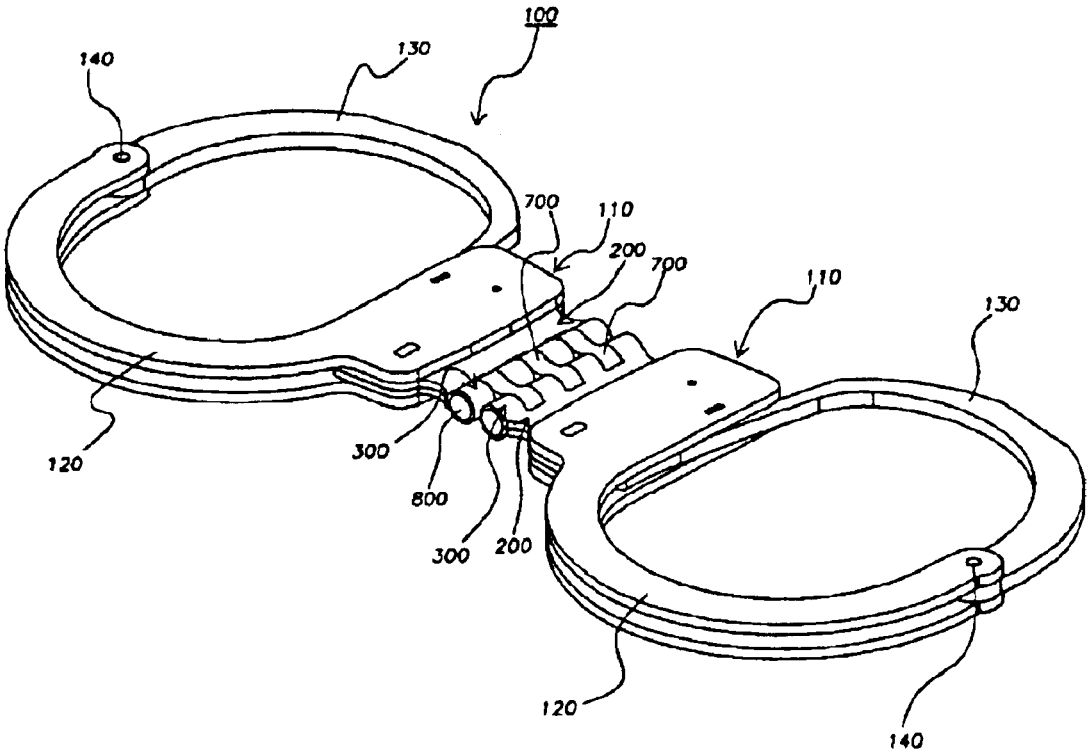
FIG. 2 is an assembled perspective view of the handcuffs according to the present invention.

As shown in FIGS. 1 and 2, the couplings (700), each of which is formed in a peanut shape having openings at its both ends, are fitted into the grooves (320) formed between the neighboring hinge members (300). The hinge axes (800), the openings (310) of the hinge members (300) and the openings of the couplings (700) are formed in such a dimension that the hinge axes (800) can be fitted into the openings (310) of the hinge members (300) and the openings of the couplings (700) and the pair of handcuffs (100) can be smoothly connected around the connecting structure.

The openings (310) of the hinge members (300) are formed merely by folding the integrally formed frame plate (200), and the openings formed at both ends of each of the couplings (700) are formed to have substantially the same size as those of the hinge members (300).

Accordingly, as shown in FIG. 2, by alternately inserting the hinge axes (800) through the openings of the hinge members (300) and the couplings (700), the pair of handcuff parts (100) can be securely connected with each other, and can be connected to look secure and elegant in appearance.

The couplings (700) serve to connect the hinge members (300) of both the base bodies (110) of the handcuff parts (100).

As an alternative, if the handcuff parts (100) are to be connected by coupling rings or chains in replacement of the hinge members (300), the frame plate (200) can be formed to have the flat members only to receive the partition plate (400) therein through the gap (210).

Figure 5:
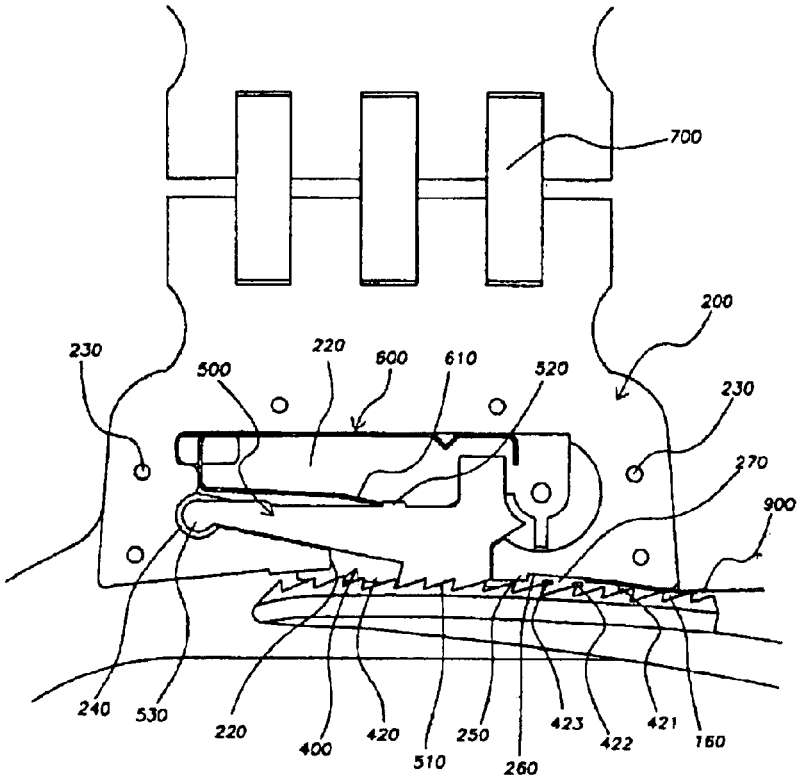
FIG. 5 is a partial plane view of the handcuffs according to the present invention, in which a base body of one handcuff part is omitted.

As shown in FIGS. 1 and 5, the pawl piece (500) is formed into a hammer shape, and is provided at its end with a rounded hinge member (530) which is fitted into a hinge groove (240) of the frame plate (200) so that the pawl piece (500) can be slightly swung about the hinge groove (240). The pawl piece (500) is also provided at the other end with a plurality of teeth (510) (three teeth in the drawings) which are engaged with the teeth (131) of the movable arm (130). Furthermore, the pawl piece (500) is provided with a protrusion (520) on the opposite side of the teeth (510) such that an end of the leaf spring (600) is engaged to the protrusion (520). Therefore, the pawl piece (500) is biased toward the teeth (131) of the ratchet portion of the movable arm (130) by the leaf spring (600).

As shown in FIGS. 1 and 5, the leaf spring (600) is formed into a "U" shape. The leaf spring (600) is in contact with a wall defining the space (220) of the frame plate (200) at its one wing portion. The end of the other wing portion of the leaf spring (600) is slightly bent and engaged to the protrusion (520) of the pawl piece (500). Accordingly, the teeth (510) of the pawl piece (500) is biased toward the teeth (131) of the ratchet portion of the movable arm (130).

The partition plate (400) is formed from a rectangular thin plate and is provided with a central rectangular space (410). The partition plate (400) is circumferentially formed with pin holes (430) corresponding to pin holes (150) of the base body (110) and pin holes (230) of the frame plate (200), so that coupling pins (not shown) are inserted in the pin holes (150, 230 and 430).

As shown in FIG. 5, the frame plate (200) is provided at each end thereof with an upwardly inclined surface (260) at a position corresponding to an inlet of a passageway (160), and is provided with a blocking protrusion (250) at an inner end of the upwardly inclined surface (260).

The pair of base bodies (110) are coupled to each other by coupling pins to define the passageway (160) therebetween, so that the moveable arm (130) is moved through the passageway (160).

Figure 4:
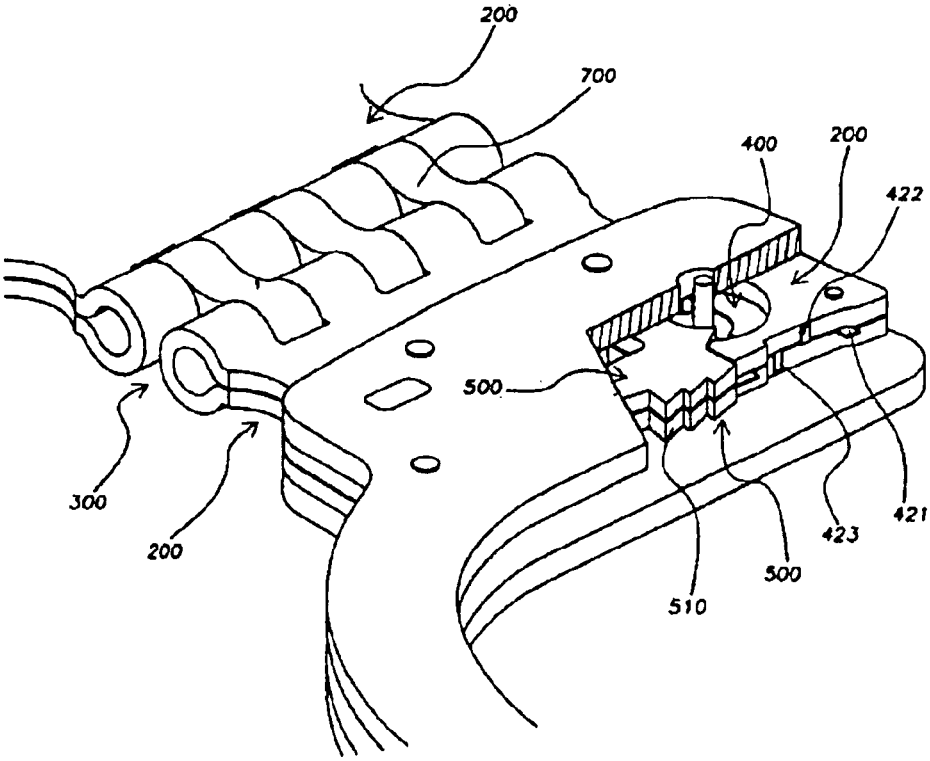
FIG. 4 is a partial perspective view of the handcuffs according to the present invention.
Figure 6:
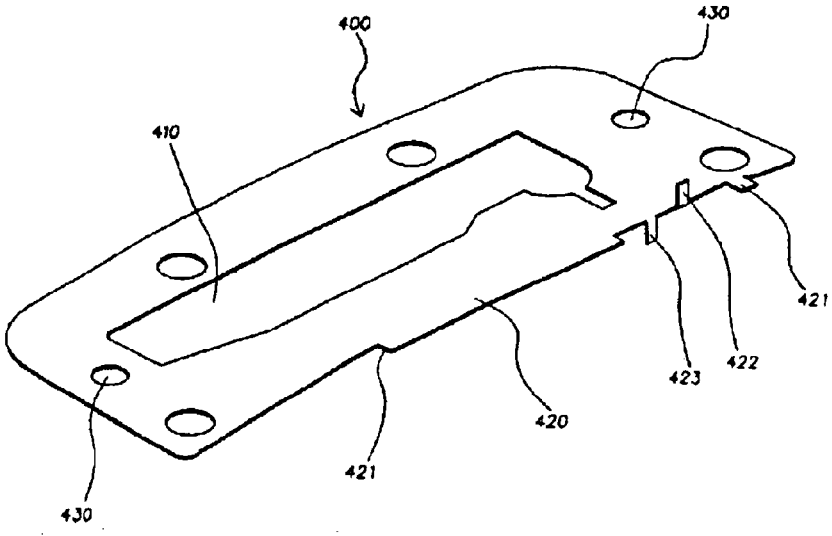
FIG. 6 is a perspective view of a partition plate of the handcuffs according to the present invention.

As shown in FIGS. 4 and 6, the partition plate (400) is disposed between the base bodies (110) to separate the pair of base bodies (110) from each other. The partition plate (400) is provided with upward and downward bent protrusions (422 and 423) such that a gap (270) is formed between the upward and downward bent protrusions (422 and 423) and the upwardly inclined surface (260) of the frame plate (200). The partition plate (400) is also provided with a dividing protrusion (421) at a position adjacent to the upward bent protrusion (422).

If a foreign metal object (900) such as a metal wire or a hair pin is introduced between the upwardly inclined surface (260) and the bent protrusions (422 and 423), it is directed to the blocking protrusion (250).

Accordingly, by the upwardly inclined surface (260) provided at the inlet of the passageway (160) of the frame plate (200), the foreign metal object (900) is directed to pass over the teeth (131) of the ratchet portion of the movable arm (130) and the bent protrusions (422 and 423) of the partition plate (400), and is then engaged to the blocking protrusion (250) of the frame plate (200). Therefore, the handcuff can be prevented from being picked by the foreign metal object (900) introduced into the base bodies (110).

The partition plate (400) is interposed between the pair of flat members of the frame plate (200) and separates one set of the pawl pieces (500) from each other.

The ratchet portion of the movable arm (130) is formed with a longitudinal partition groove (132) between the dual line of teeth (131) so that the movable arm (130) can be guided by sliding of the partition groove (132) on an elongated guide protrusion (420) and the dividing protrusion (421) of the partition plate (400).

As described above, according to the present invention, handcuffs are provided by the methods of shearing and bent-up forming in replacement of the conventional cast-iron method.

According to the handcuffs of the present invention, a frame plate consisting of flat members included in the base bodies and hinge members exposed to the outside of the base bodies is integrally formed as one body.

Further, in the handcuffs according to the present invention, the partition plate is interposed between the flat members of the integrally formed frame plate through a gap, so that the partition plate can be assembled quickly into the frame plate and fixed therein securely, and consequently the teeth of the ratchet portion of the movable arm can be securely engaged with the pawl pieces in the base bodies.

Furthermore, according to the present invention, handcuffs cannot be picked or disassembled by an external impact or an unwanted insertion of a foreign metal object.

It will be apparent to those skilled in the art that various modifications and variations can be made to the present invention without departing from the spirit and scope of the invention. The present invention covers the modifications and variations thereof provided they come within the scope of the appended claims and their equivalents.

What is claimed is:

1. Handcuffs comprising a pair of handcuff parts and a connecting structure, wherein each of the handcuff parts comprises:

a pair of rectangular base bodies which accommodate both ends of a frame plate, a partition plate interposed between the ends of the frame plate, a pair of pawl pieces and a leaf spring therebetween; a movable arm formed in a semi-circle shape, which is provided at its free end with a ratchet portion formed with dual line of teeth; and a pair of fixed arms formed in a semi-circle shape, which are pivotably connected at free ends thereof to the other end of the movable arm by a pivot pin and are integrally provided at their other ends with the base bodies, and wherein the connecting structure comprises:

two frame plates, each of which includes a plurality of hinge members exposed to the outside of the base bodies, forming grooves between the neighboring hinge members and having openings therethrough, and also includes a pair of flat members at its both ends integrally extended from the hinge members to be contained in the base bodies; a plurality of couplings fitted into the grooves of the hinge members of both the frame plates, each of the couplings having openings at its both ends; and hinge axes to be axially fitted into the openings of the hinge members and the openings of the couplings.

2. Handcuffs as claimed in claim 1, wherein the frame plate has a gap between the two flat members to receive and fix the partition plate therein.

3. Handcuffs as claimed in claim 1, wherein each of the hinge members integrally extended from the ends of the flat members is separated from each other by the same interval, thus forming a groove with a neighboring hinge member.

4. Handcuffs as claimed in claim 1, wherein each of the couplings having openings at its both ends is fitted into the grooves formed between the neighboring hinge members, and the hinge axis is alternately fitted into the openings of the hinge members and the openings of the couplings.

5. Handcuffs as claimed in claim 3, wherein each of the couplings having openings at its both ends is fitted into the grooves formed between the neighboring hinge members, and the hinge axis is alternately fitted into the openings of the hinge members and the openings of the couplings.

6. Handcuffs as claimed in claim 1, wherein the frame plate is provided at each end thereof with an upwardly inclined surface at a position corresponding to an inlet of a passageway which is defined by the pair of base bodies, and is provided with a blocking protrusion at an inner end of the upwardly inclined surface, and the partition plate is provided with upward and downward bent protrusions to form a gap with the upwardly inclined surface of the frame plate and is also provided with a dividing protrusion at a position adjacent to the upward bent protrusion, and thus if a foreign metal object is introduced between the upwardly inclined surface and the bent protrusions, it is directed to the blocking protrusion.

* * * * *